US007527216B2

(12) United States Patent
Manning, Jr. et al.

(10) Patent No.: US 7,527,216 B2
(45) Date of Patent: May 5, 2009

(54) CONTINUOUS YARN DELIVERY CREEL

(75) Inventors: Thomas W. Manning, Jr., Waynesboro, VA (US); Ronald D. Bing-Wo, Stuarts Draft, VA (US)

(73) Assignee: INVISTA North America S. ar. l., Wilmington, DE (US)

( * ) Notice: Subject to any disclaimer, the term of this patent is extended or adjusted under 35 U.S.C. 154(b) by 86 days.

(21) Appl. No.: 11/181,902

(22) Filed: Jul. 15, 2005

(65) Prior Publication Data

US 2006/0011771 A1 Jan. 19, 2006

Related U.S. Application Data

(60) Provisional application No. 60/588,349, filed on Jul. 16, 2004.

(51) Int. Cl.
*B65H 57/18* (2006.01)

(52) U.S. Cl. ..... 242/566; 242/551

(58) Field of Classification Search ..... 242/551, 242/560, 564.3, 564.4, 566, 591, 593, 594, 242/594.5, 594.6, 597, 597.5, 597.8, 131, 242/131.1, 128, 485.2; 226/11
See application file for complete search history.

(56) References Cited

U.S. PATENT DOCUMENTS 3,915,406 A * 10/1975 Rolli et al. ..... 242/131
4,015,314 A * 4/1977 Hurst et al. ..... 28/146
4,792,101 A * 12/1988 Van Bogaert et al. ..... 242/416
4,948,067 A * 8/1990 Gutschmit ..... 242/131
5,732,899 A * 3/1998 Wells ..... 242/423.1
6,676,054 B2 1/2004 Heaney et al.
2003/0006331 A1* 1/2003 Heaney et al. ..... 242/131
2004/0104299 A1* 6/2004 Heaney et al. ..... 242/593
2005/0133653 A1* 6/2005 Heaney et al. ..... 242/410

FOREIGN PATENT DOCUMENTS

WO WO 02/076866 A1 * 10/2002

* cited by examiner

*Primary Examiner*—Peter M Cuomo
*Assistant Examiner*—William E Dondero
(74) *Attorney, Agent, or Firm*—Christina W. Geerlof

(57) ABSTRACT

An apparatus and method for unwinding yarns with: (1) a drive roll with a polished metal finish to ensure good fiber/metal contact; (2) a drive roll/separator roll combination that enables multiple wraps of yarn on the drive roll; (3) pivoting yarn holding arms for the active and standby packages that provide for easier access to the packages on a frame; and (4) in combination with the pivoting yarn holding arms, one or more pivoting legs extending from a frame so that the apparatus has a relatively small footprint and simplified yarn threading/string-up as compared to background art OETO apparatus.

9 Claims, 14 Drawing Sheets

CONTINUOUS YARN DELIVERY CREEL

FIELD OF THE INVENTION

The present invention relates to yam unwinding devices, and more specifically to a method and apparatus designed to continuously deliver as-spun over-end-take-off yarn to manufacturing equipment.

BACKGROUND OF THE INVENTION

A background art example of a method for unwinding of yarns from a creel is the over-end-take-off (OETO) method. The OETO method allows for continuous operation of the unwinding process since the terminating end of the yarn of an active package is attached to the leading end of the yarn of a standby package. In the OETO method, after the active package is fully exhausted, the standby package becomes the active package. However, a drawback of the OETO method is that unacceptable yarn tension variations can occur during the unwinding process.

A background art example of a system and apparatus that implements the OETO method was disclosed in Research Disclosure, p. 729, November 1995, item #37922. In particular, the disclosure describes an OETO system that elastomeric fibers are passed through before being fed to a manufacturing line. The OETO system of the disclosure has a rack structure that holds the creels of active packages and standby packages, a relaxation section and motor driven nip rolls. The relaxation section is located between an active package and the nip rolls of the OETO system. The relaxation section helps to suppress the unacceptable yarn tension variations discussed above by providing some slack in the yarn being unwound.

However, background art OETO systems that include such a relaxation section have problems with fibers or yarns that exhibit high levels of tack (i.e., yarns having particularly high cohesive forces). Moreover, yarns with high levels of tack also display unusually high variations in frictional forces and yarn tension levels as the active package is unwound from the creel.

In addition, the slack in the yarn provided by the relaxation section can vary, and excess yarn can be unwound from the active package. This excess yarn can be drawn into the nip rolls and wound upon itself leading to entanglement or breakage of the yarn. Use of yarns with high levels of tack further contributes to the possibility of the excess yarn adhering to itself and to the nip rolls. The entanglement or breakage of yarns during the unwinding process requires the manufacturing line to be stopped, delays the unwinding process and increases the cost of manufacturing.

Background art OETO apparatus are typically configured such that the yarn horizontally traverses the relaxation section. In this configuration, the yarn travels through nip rolls with axes that are vertical. However, with such a vertical configuration for the axes of the nip rolls, the yarn located in the relaxation section between the active package and the nip rolls tends to sag. As a result, the yarn position on the nip rolls can become unstable, and interference and entanglement can occur between adjacent yarns. Each of these problems would require the manufacturing line to be stopped.

Furthermore, some manufacturing applications (e.g., diaper manufacturing) require the use of as-spun fiber that is substantially finish-free. Such finish-free yarns also exhibit the problems associated with high levels of tack discussed above.

The problems discussed above make applying OETO methods and apparatus particularly difficult when processing yarn with a high level of tack. Background art OETO apparatus have attempted to address these problems in the unwinding process by: (1) using yarns with anti-tack additives applied prior to winding; and/or (2) using rewound packages, where an active package is unwound and then rewound on a different creel to create a rewound package. Both of these approaches add additional expense to the manufacturing and unwinding processes.

As a result of the problems discussed above, OETO apparatus of the background art have been designed to take into account the difficulties due to the relaxation section, high levels of tack and breakage in yarns unwound with the OETO method. As an example, U.S. Pat. No. 6,676,054 (Heaney et al.) discloses an OETO method and apparatus for unwinding elastomeric fiber packages with high levels of tack from a package. In particular, the OETO apparatus of Heaney et al. requires that a minimum distance exists between a fiber guide and the fiber package. In accordance with Heaney et al., minimum distances less than 0.41 meter can result in undesirably large tension variations. These variations can cause process control difficulties and can also lead to yarn breakages. Further, in accordance to Heaney et al, distances longer than 0.91 meter make the unwinding equipment less compact and ergonometrically less favorable. As the level of tack exhibited by the fiber increases, the minimum allowable distance, d, increases. For yams with tack levels greater than about 2 grams and less than about 7.5 grams, d is preferably at least about 0.41 meter; and for fibers with tack levels greater than about 7.5 grams, d is preferably at least about 0.71 meter.

However, due to such minimum distance and other requirements for high tack yarns, OETO apparatus typically requires a frame with a large footprint that can take up significant floor space in a manufacturing environment.

Therefore, there is a need in the art for an OETO apparatus for unwinding yarns with high levels of tack that avoids the problems of entanglement, breakage and increased manufacturing costs of the methods and apparatus of the background art. Moreover, there is a need in the art for an OETO apparatus for unwinding yarns with anti-tack additives that can be implemented in a relatively small footprint.

SUMMARY OF THE INVENTION

The present invention is an apparatus for unwinding yarns with: (1) a drive roll with a polished metal finish to ensure good fiber/metal contact; (2) a drive roll/separator roll combination that enables multiple wraps of yarn on the drive roll; (3) pivoting yarn holding arms for the active and standby packages that provide for easier access to the packages on a frame; and (4) in combination with the pivoting yarn holding arms, one or more pivoting legs extending from a frame so that the apparatus has a relatively small footprint and simplified yam threading/string-up as compared to background art OETO apparatus.

One embodiment of the present invention is an apparatus for continuously unwinding yarns that has a frame with at least one pivoting leg connected to the frame; a drive control assembly, preferably attached to the frame and configured to continuously unwind yarns from one or more active packages; an electrical control box preferably attached to the frame and electrically connected to the drive control assembly; two or more pivoting yam holding arms attached to each pivoting leg; and first yarn guides attached to the frame. The pivoting legs of the frame are located at acute angles relative to the frame so that they may be adjusted to provide a small apparatus footprint to take up less space in a manufacturing area. The first yam guides are separated from the active packages by a minimum distance, preferably at least 0.34 meters.

Another embodiment of the present invention is a method for unwinding yarns continuously comprising: (a) holding an active package on a pivoting arm such that at least one yarn can unwind from the active package in a direction defining an acute angle with the rotational axis of the active package; (b) unwinding yarn from the active package of step (a) at a controlled predetermined rate; (c) controlling the direction of said yarn of step (a) by passing the yarn through first yam guides; and (d) controlling the minimum distance (d) from said first yarn guides to the end of said active package facing said first yam guides, measured on a line defined by the rotational axis of the active package, such that said distance (d) is equal to:

i. at least about 0.34 meter for yarns with tack of greater than about 2 grams OETO and less than about 7.5 grams OETO; or ii. from about 0.71 meter to about 0.91 meter for yarns with tack greater than about 7.5; (e.) controlling an angle (θ), defined by the intersection of imaginary lines corresponding, respectively, to the rotational axis of the active package and the central axis of said first yarn guide that is perpendicular to the plane of the orifice, such that said angle (θ) is equal to:

i. 0° to about 30° for yarns with tack greater than about 2 grams OETO and less than about 7.5 grams OETO; or ii. 0° to about 10° for yarns with tack levels greater than about 7.5 grams OETO.

BRIEF DESCRIPTION OF THE DRAWINGS

Several embodiments of the invention will now be further described in the following more detailed description of the specification when read with reference to the accompanying drawings in which.

DETAILED DESCRIPTION OF THE INVENTION

The apparatus for unwinding yarns of the present invention allows for the cost efficient use of an OETO method with rewound yarn and/or as-spun OETO yarn with anti-tack additives. In particular, the apparatus of the present invention continuously unwinds as-spun OETO yarns and delivers a relatively constant yarn tension in a relatively small footprint. This provides for improved efficiency in manufacturing processes.

Figure 1:
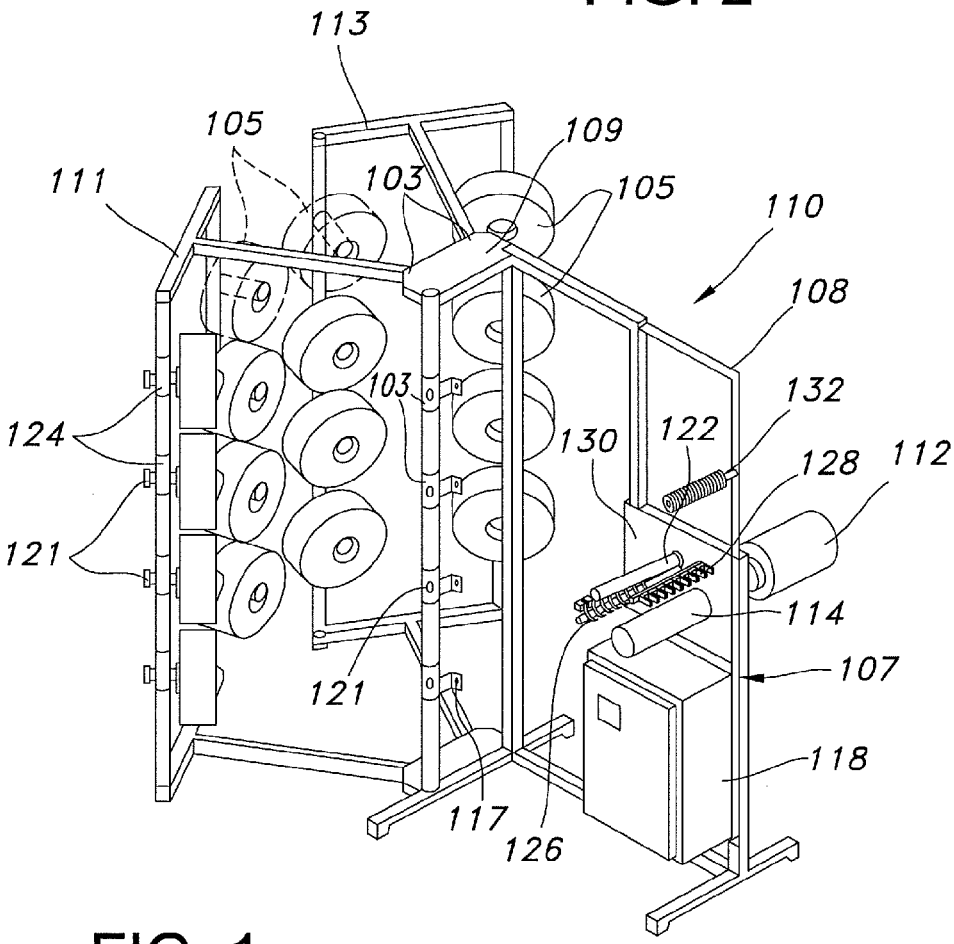
FIG. 1 is an exemplary perspective view showing an OETO apparatus for continuous unwinding of yarns.

FIG. 1 is an exemplary perspective view showing one embodiment of the apparatus of the present invention for continuous unwinding of yarns. FIG. 1 shows a frame 110 with two pivoting legs 111, 113 that are connected to a central leg portion 109 shown in FIG. 1 as two parallel posts with bridging supports therebetween. Central leg 109 thus extends from one side of frame 110 in the embodiment shown in FIG. 1.

Figure 2:
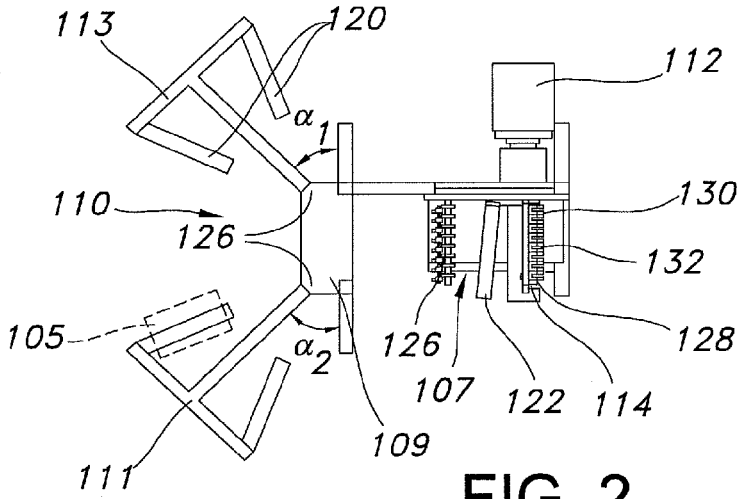
FIG. 2 is an exemplary top plan view of the apparatus for unwinding yarns shown in FIG. 1.

The pivoting legs 111, 113 contain pivoting yarn holding arms 120 (FIG. 2). The pivoting yarn holding arms 120 hold creels for up to eight packages 105 on each of the pivoting legs 111, 113. The packages 105 may be either active packages or standby packages. The pivoting legs 111, 113 of the frame 110 are set at acute angles ($\alpha_1$,$\alpha_2$) relative to the central leg 109 in order to provide a versatile and small footprint for the frame 110. The acute angles ($\alpha_1$,$\alpha_2$) are in the range of 0° to 90°. As a result, the frame can be configured with various orientations of the two pivoting legs 111, 113 to optimize space on a manufacturing floor.

In addition, FIG. 1 shows first yarn guides 117 and a drive control assembly 107 that are attached to the central leg 109 of frame 110. The drive control assembly 107, as shown in FIG. 1, further comprises a drive motor 112, a drive roll 114, an electrical control box 118, a separator roll 122, second yarn guides 126, break sensors 128, and third yarn guides 132. A non-limiting value for the number of first yarn guides 117, second yarn guides 126, break sensors 128 and third yarn guides 132 is eight. The drive control assembly 107 is shown in greater detail FIG. 3 below.

A non-limiting example of an active and a standby package 105 is a full 3 kg creel package of a wound fiber or yarn. While not wishing to be limited, an exemplary yarn for OETO unwinding is spandex (segmented polyurethane), such as LYCRA® sold by INVISTA (formerly DuPont). The active and standby packages 105 typically occupy either of two adjacent pivoting yarn holding arms 120 positions on the small footprint frame 110. The pivoting yarn holding arms 120 pivot for easy access to the active and standby packages 105. The pivoting yarn holding arms 120 hold regular yarn tube cores (e.g., as-spun OETO material).

FIG. 2 is a top plan view of the apparatus for unwinding yarns shown in FIG. 1. As can be seen in FIG. 2, the frame 110 is designed to provide a versatile configuration and a small footprint by placing the two pivoting legs 111, 113 of the frame 110 that hold the packages 105 at acute angles acute angles ($\alpha_1$,$\alpha_2$) relative to the central leg 109. Because the two legs 111, 113 can be moved and because the frame 110 has a small footprint, the present invention takes up less floor space in a manufacturing environment.

Figure 3:
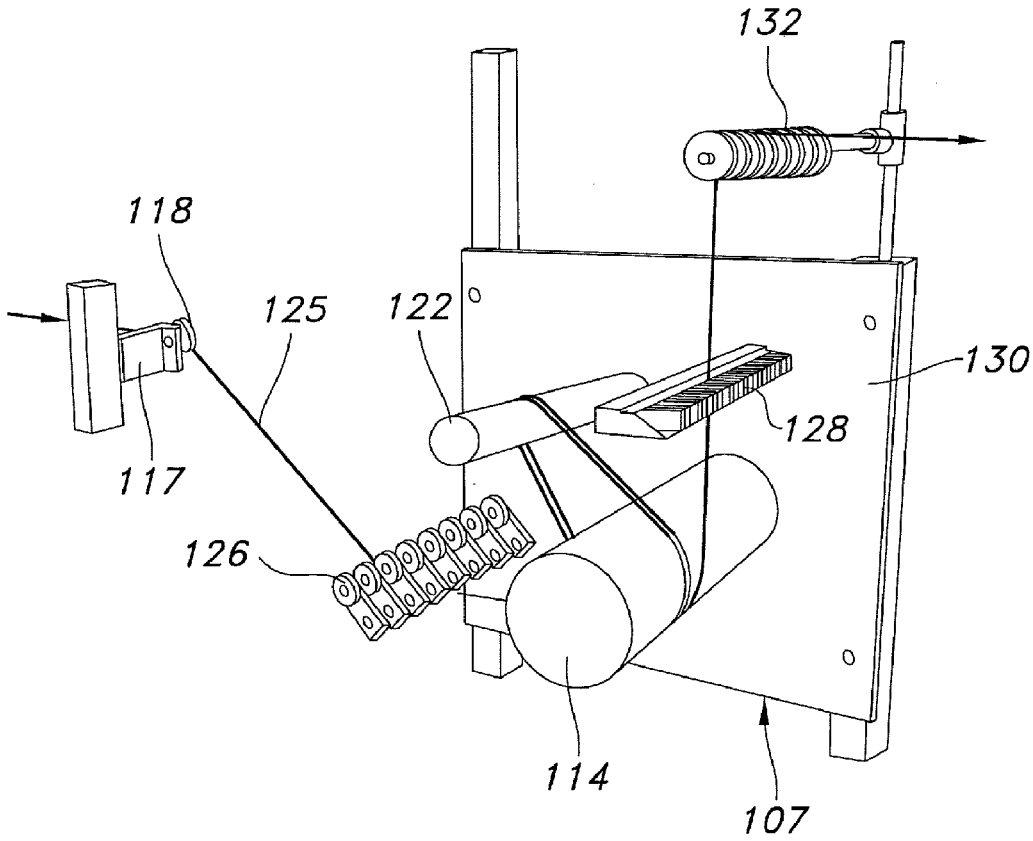
FIG. 3 is an exemplary detailed view of the drive control assembly.

FIG. 3 shows a more detailed view of the drive control assembly 107. In this embodiment, the drive roll 114 is mounted below the separator roll 122. The second yarn guides 126 are mounted on either side of the separator roll 122. The second yarn guides 126 are mounted before the separator roll 122, and before and lateral to the drive roll 114. The break sensors 128 are mounted above and to the right of the drive roll 114. The third yarn guides 132 are mounted above and after each of the separator roll 122, drive roll 114 and break sensors 128. The third yarn guides 132 may be mounted on the drive control assembly front panel 130 or on the small foot print frame 110. The position of the third yarn guides 132 relative to the separator roll 122, drive roll 114 and break sensors 128, is as discussed above.

In addition, FIG. 3 shows multiple wraps of yarn around the drive roll 114. The multiple wraps of yarn around the drive roll 114 ensure positive feeding without yarn slippage. This helps to avoid entanglement and breakage that occurred with background art OETO apparatus.

Figure 4:
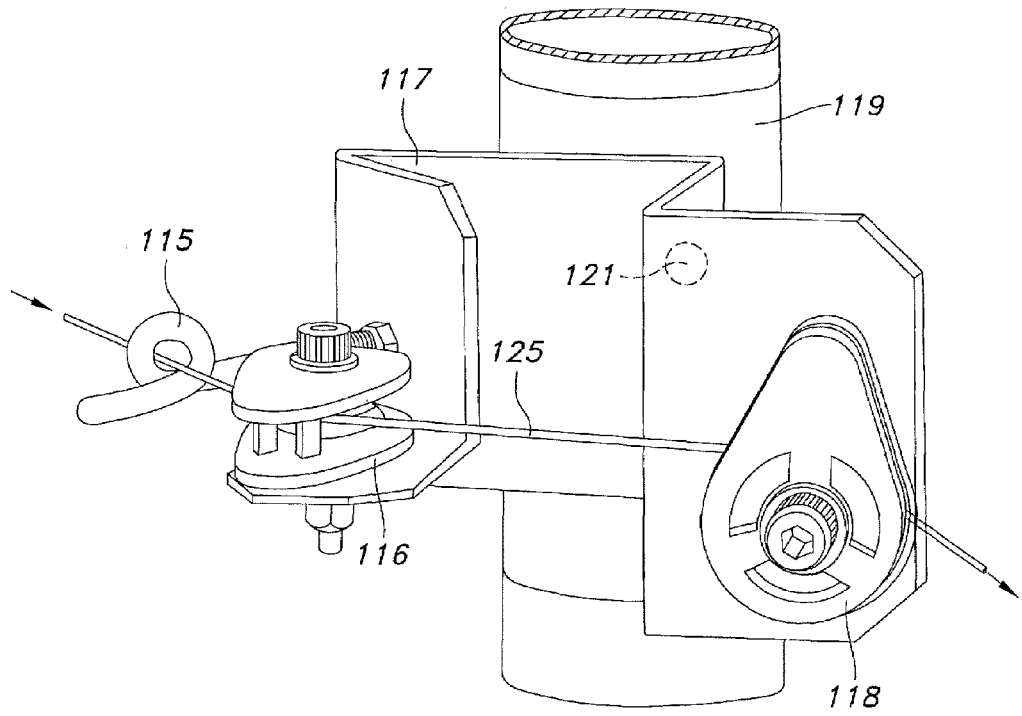
FIG. 4 is an exemplary detailed perspective view of the path of the yarn through a guiding system that passes the yarn from the active or standby packages to the drive roll.

FIG. 4 shows the details of the path of the yarn through a guiding system that passes the yarn/fiber 125 from the active or standby packages 105 to the drive roll 114. Pivoting guide brackets 117 are mounted on sleeves 119 that allow the pivoting guide brackets 117 to pivot on the central leg 109 of the frame 110. The pivoting guide brackets 117 are secured in a particular position with a securing screw 121. The pivoting guide brackets 117 are adjusted in accordance with the acute angles at which the pivoting legs 111, 113 are set. The pivoting brackets 117 include, but are not limited to, a pigtail guide 115 and yarn guides 116, 118 that direct the yam to the second yarn guides 126 attached to the drive control assembly panel 130. The use of pigtail guides 115 in this path increases the ease of loading/stringing-up the active and standby packages in comparison to the use of eyelets in the background art apparatus. Horizontally mounted yarn guide 116 is positioned closest to the pigtail guide 115 and vertically mounted yarn guide 118 is positioned on a vertical surface of the bracket on a vertical surface of the bracket 117.

Preferably, the yarn/fiber 125 is selected from those referred to as spandex or segmented polyurethane. A particularly preferred spandex is offered under the Lycra® trademark and can be obtained from INVISTA® INCORPORATED, 4417 Lancaster Pike, Wilmington, Del. 19805. Preferred grades of Lycra® spandex include, but are not limited to: Type 151 and Type 262P.

The fabricated parts for the frame (e.g., pivoting holding arms 120 pivoting bracket 117) can be obtained, for example, from Industrial Machine Works, 444 North Bayard Avenue, Waynesboro, Va. USA. The motor and electrical control box 118 cabinet can be obtained, for example, from MSC Industrial Supply Company, 75 Maxess Road, Melville, N.Y. USA. The components comprising the electrical control box 118 can be purchased, for example, from Control Corporation of America, 1255 Trapper Circle NW, Roanoke, Va. 24012.

Figure 5A:
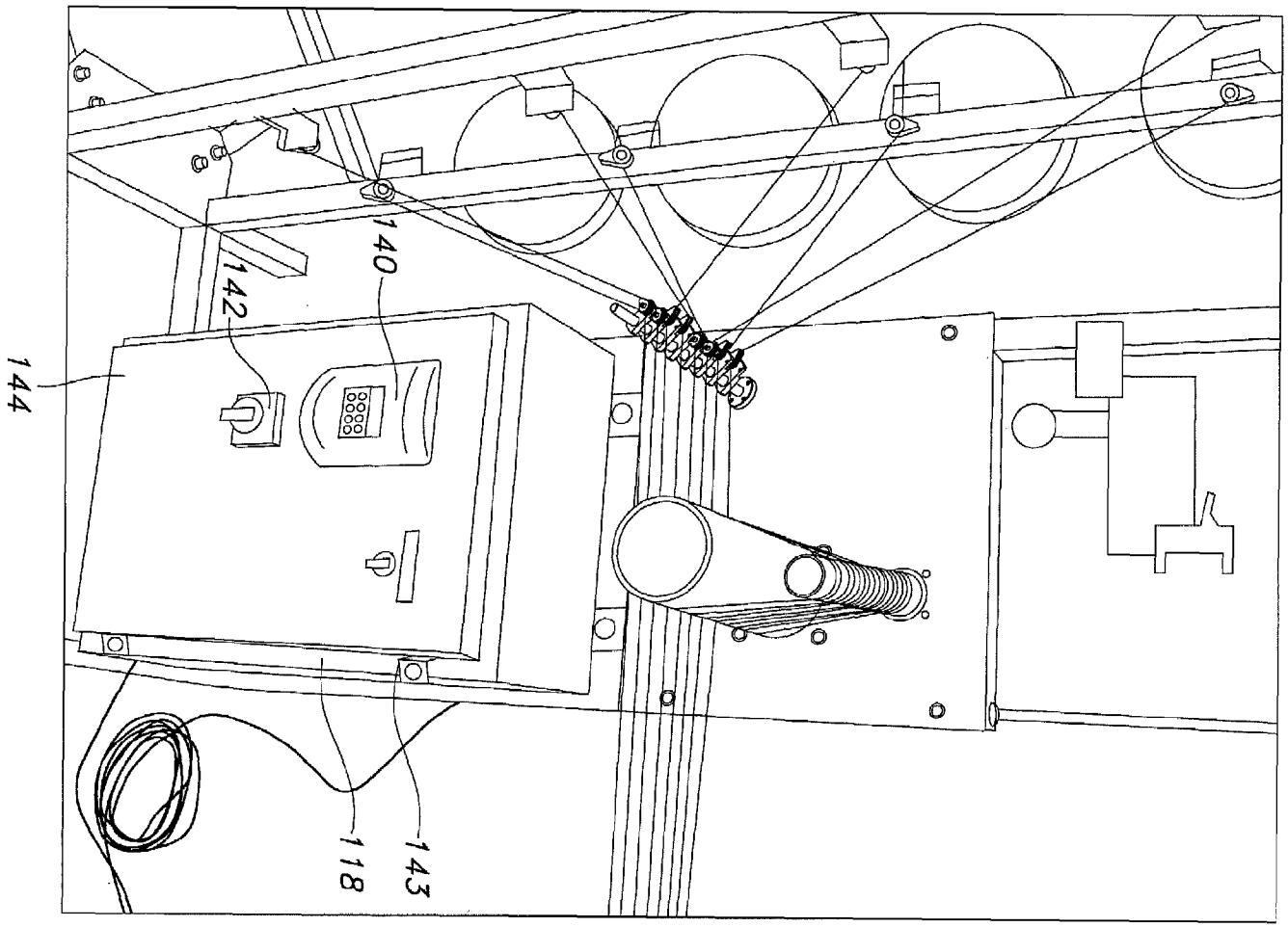
FIG. 5A is an exemplary exterior view of the electrical control box.

FIG. 5A is a front view of the electrical control box 118. In particular, FIG. 5A shows a drive access panel 140, power disconnect switch 142 and mode selector switch 143 that are mounted on the access door 144 of the electrical control box 118.

Figure 5B:
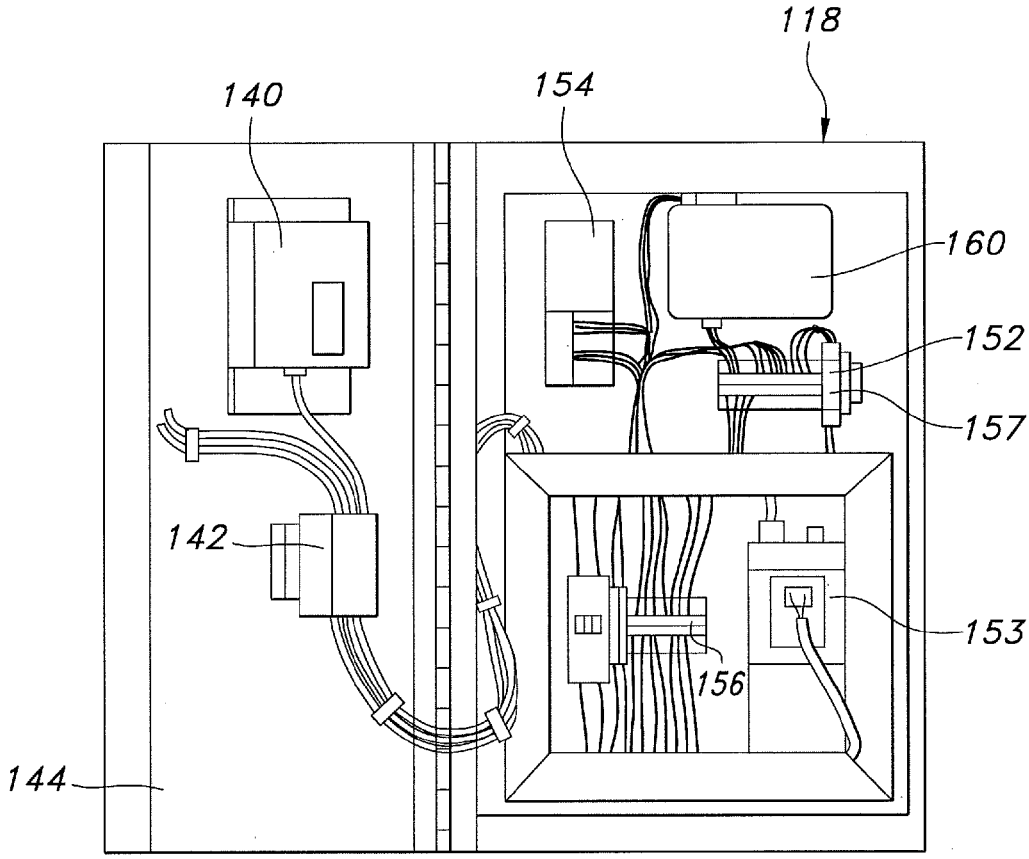
FIG. 5B is an exemplary interior of the electrical control box.
Figure 5C:
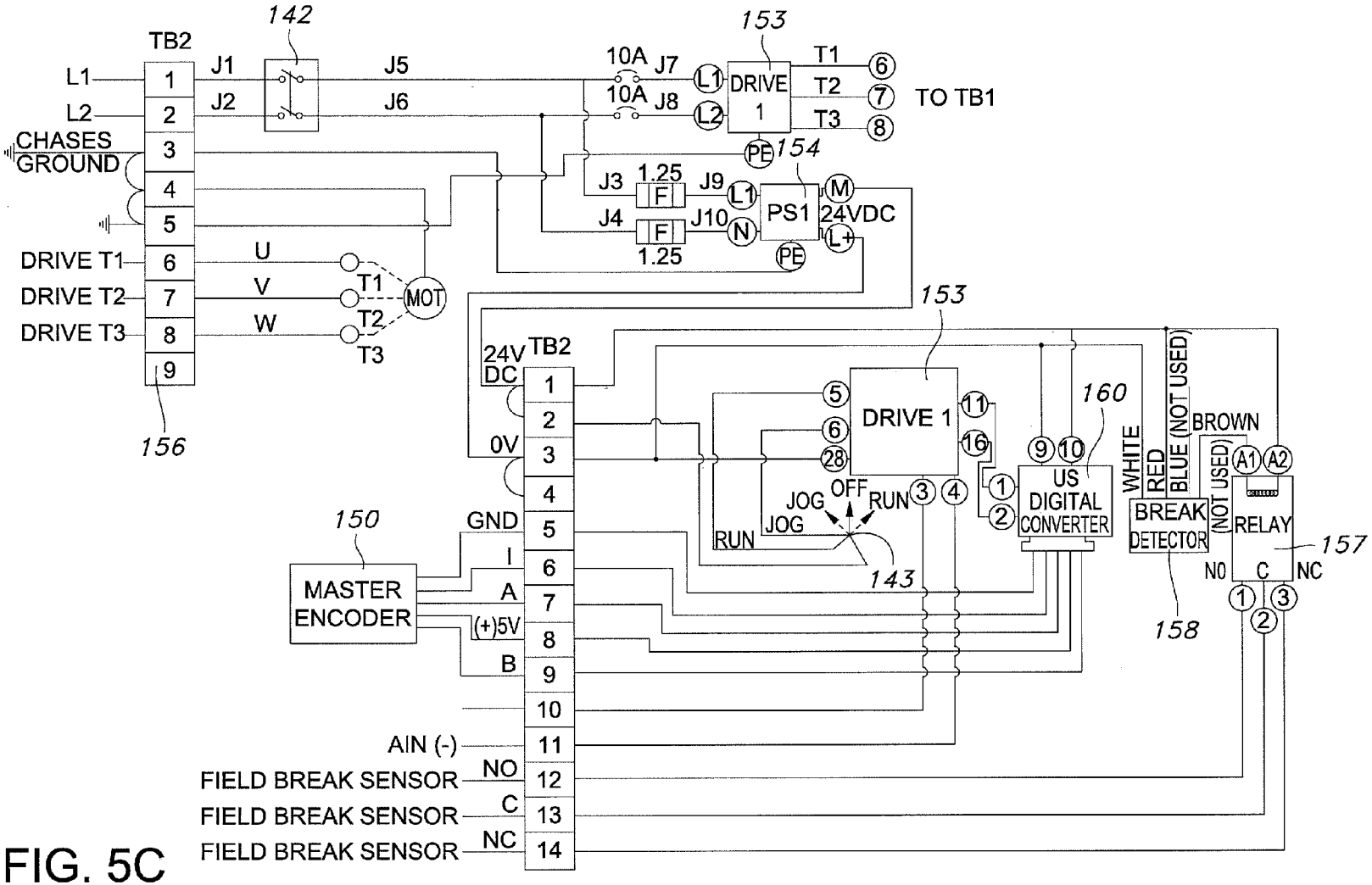
FIG. 5C is an exemplary schematic diagram of the electrical control box.

FIG. 5B shows a view of the interior of the electrical control box 118. In particular, FIG. 5B shows terminal blocks 152, 156 that provide an interface connection for signals for the components of the electrical control box 118. Non-limiting examples of the major components of the electrical control box 118 include, but are not limited to, a master encoder 150 (not shown), power supply 154, drive motor controller 153, relay 157, break detector interface 158 (not shown) and digital converter 160. A schematic diagram showing the interconnection of these components is set out in FIG. 5C. The break detector interface 158 and the drive motor controller 153 are electrically connected to the break detectors 128 and the drive motor 112, respectively, of the drive control assembly 107. The master encoder 150 may be provided externally and the break detector interface 158 may be a part of the break detectors 128.

The motor and electrical control box 118 cabinet can be obtained, for example, from MSC Industrial Supply Company, 75 Maxess Road, Melville, N.Y. USA. The components comprising the electrical control box 118 can be purchased, for example, from Control Corporation of America, 1255 Trapper Circle NW, Roanoke, Va. 24012. The electrical control cabinet An alternative configuration (not shown) for the frame 110 would mount a second yarn holding arm, located at an angle of 180° relative to each of the existing pivoting yarn holding arms, on the frame. This alternative configuration would permit one to hand additional yarn creels on the small footprint frame 110, thus providing more active and standby packages 105 ready for use in the manufacturing process.

Figure 6B:
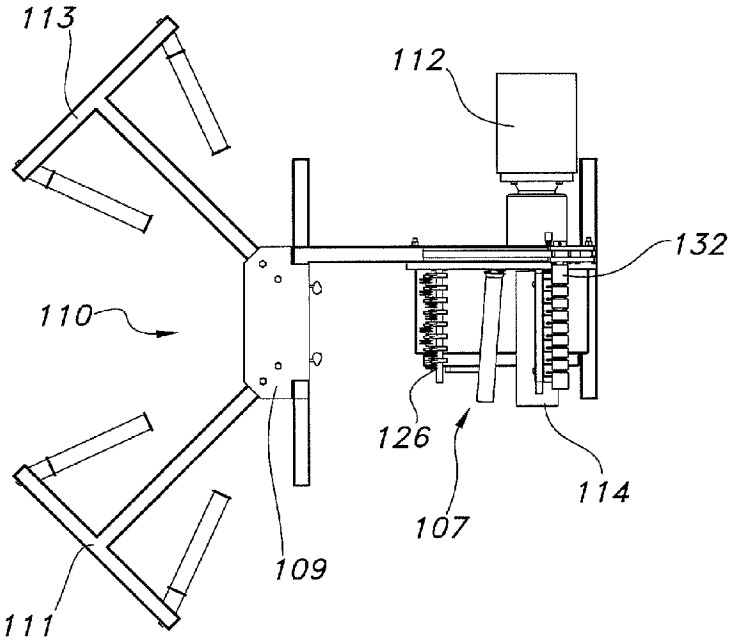
FIG. 6B is an exemplary top plan view of the apparatus for unwinding yarns shown in FIG. 6A.
Figure 6A:
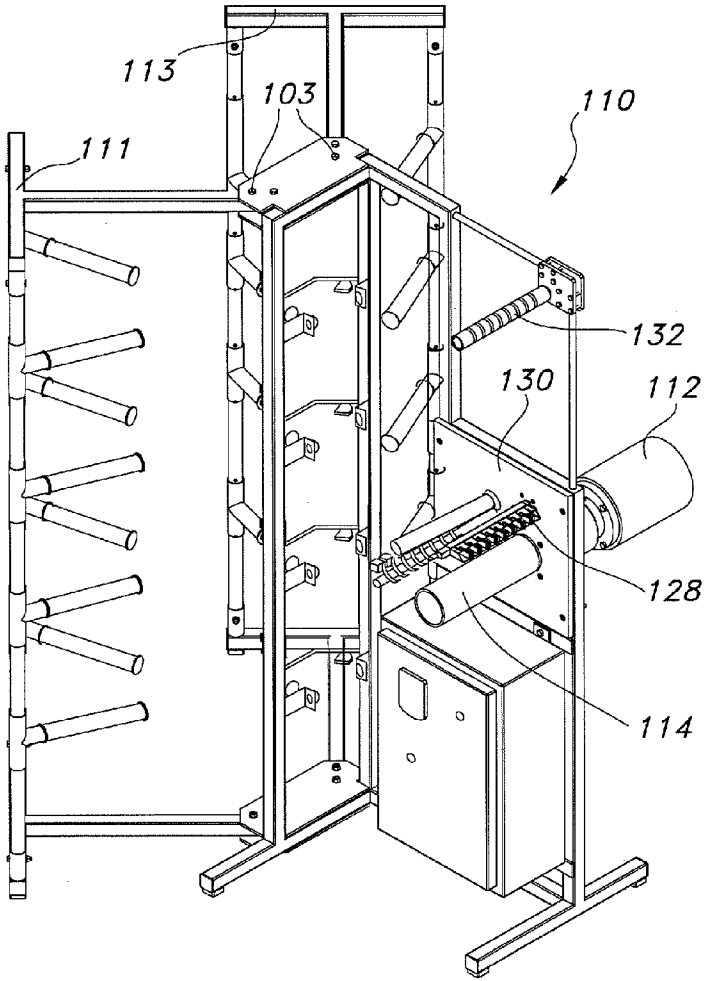
FIG. 6A is an exemplary perspective view showing an OETO apparatus for continuous unwinding of yarns.

FIG. 6A is another exemplary perspective view showing an OETO apparatus for continuous unwinding of yarns. FIG. 6B is an exemplary top plan view of the apparatus for unwinding yarns shown in FIG. 6A.

The fabricated parts for FIG. 6A can be obtained, for example, from Industrial Machine Works, 444 North Bayard Avenue, Waynesboro, Va. USA. The motor and electrical control box cabinet of FIG. 6A can be obtained, for example, from MSC Industrial Supply Company, 75 Maxess Road, Melville, N.Y. USA. The components comprising the electrical control box can be purchased, for example, from Control Corporation of America, 1255 Trapper Circle NW, Roanoke, Va. 24012.

FIG. 7 to FIG. 12 are exemplary graphs of test results using the OETO apparatus of the present invention. The yarn/fiber used for tests is selected from those referred to as spandex or segmented polyurethane. A particularly preferred spandex is offered under the LYCRA® trademark and can be obtained from INVISTA S.àr.l., Wichita, Kans. Preferred grades of LYCRA® spandex include, but are not limited to: Type 151 and Type 262P. For FIG. 9, FIG. 10 and FIG. 12, the concentration of anti-tack additives is in the range of 0.05% to 1%. The legend of each figures gives parameters particular to the test such as unwind and take-up speed in feet-per-minute (FPM). The legend of each figure also indicates the lot number of the yarns, test date and the age of the yarns-under-test.

Figure 7:
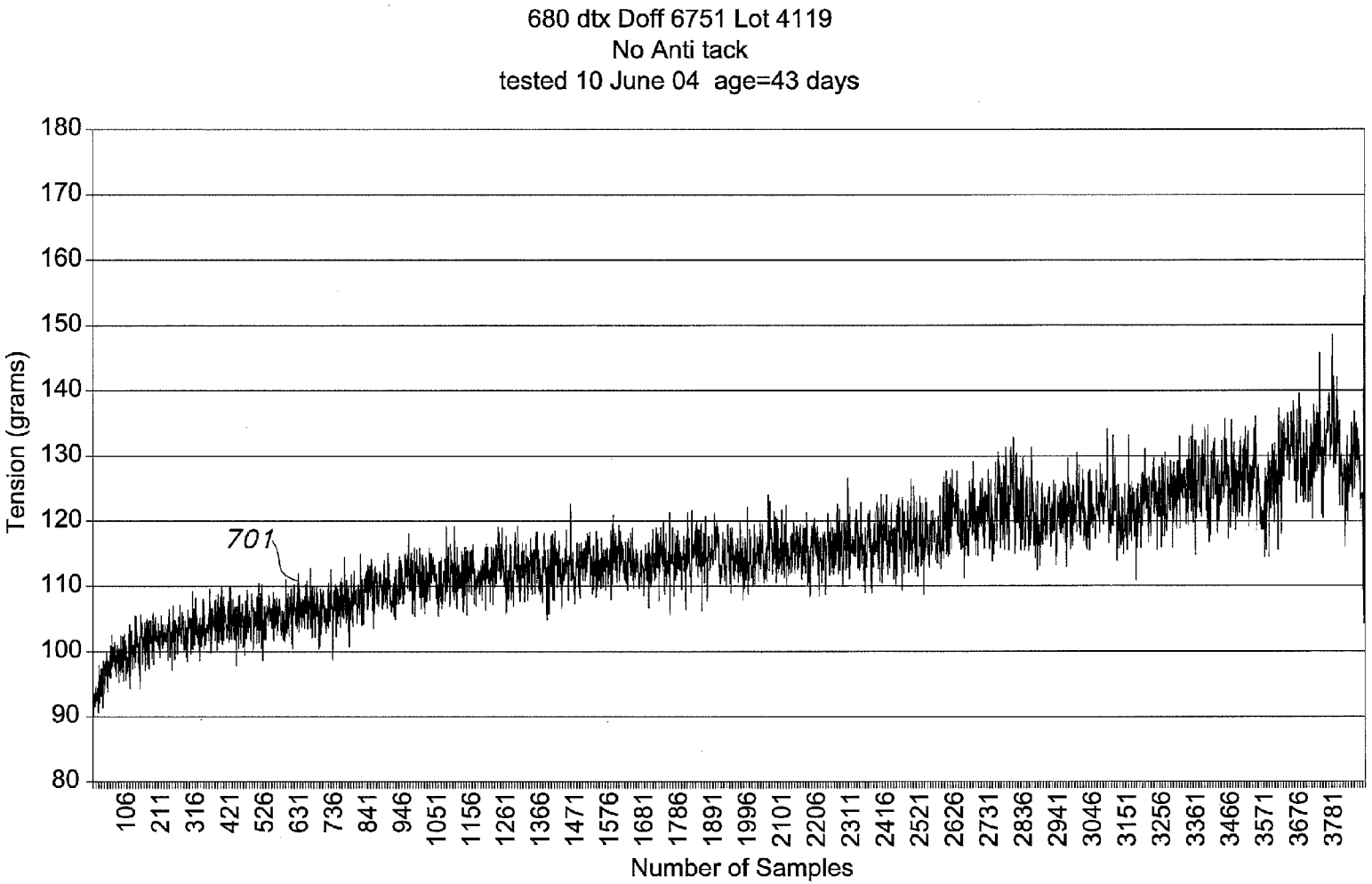
FIG. 7 is an exemplary graph showing test results of tension measurements on a yarn without anti-tack additives using the OETO apparatus of the present invention.

FIG. 7 is an exemplary graph showing test results of tension measurements on a yarn without anti-tack additives using the OETO apparatus of the present invention. As can be seen in FIG. 7, the yam tension 701 starts out at about 95 grams and climbs to about 140 grams at the end of the test cycle. This corresponds to an increase of about 47% in the yam tension.

Figure 8:
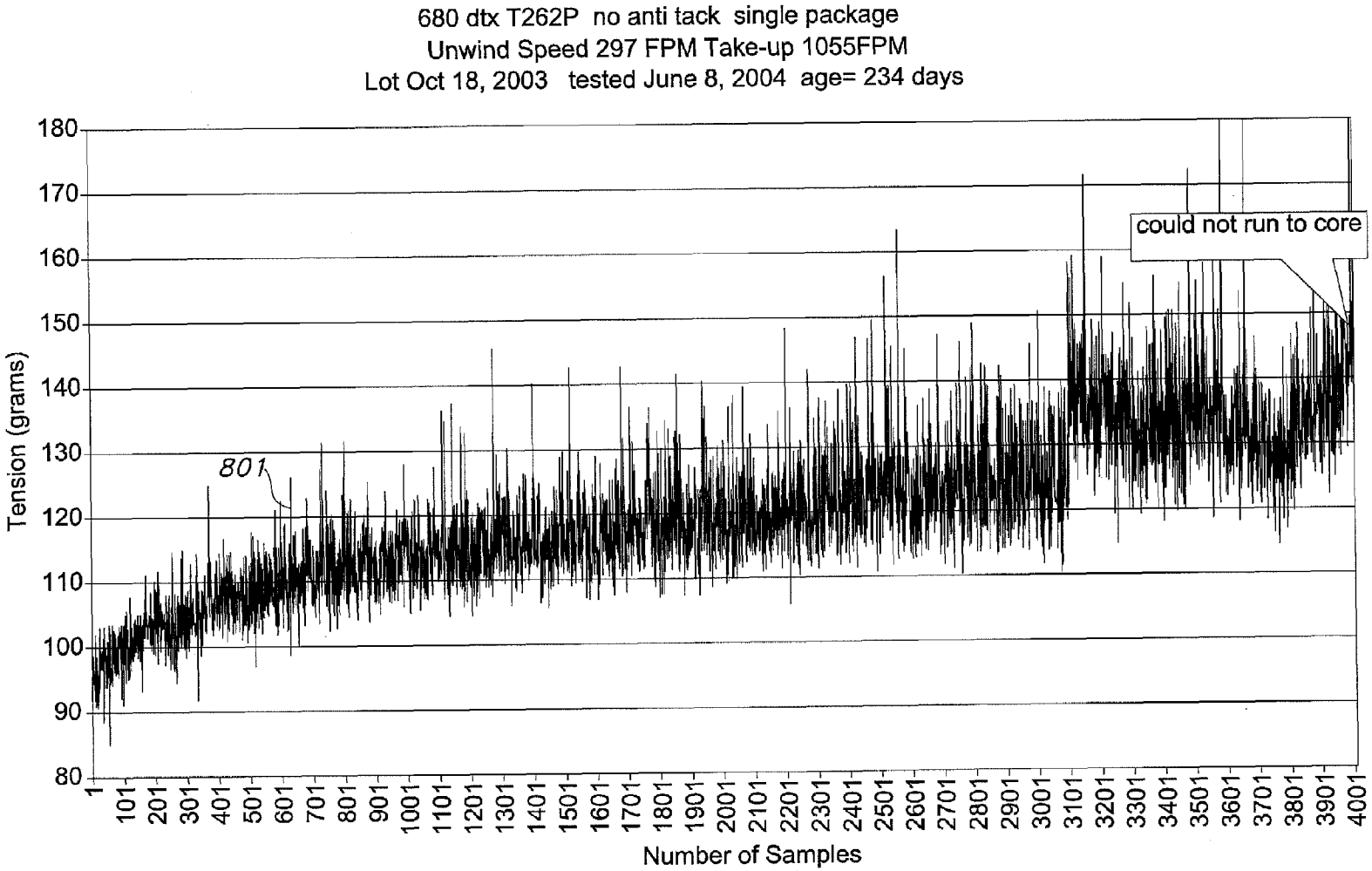
FIG. 8 is another exemplary graph showing test results of tension measurements on a yarn without anti-tack additives using the OETO apparatus of the present invention.

FIG. 8 is an exemplary graph showing test results of tension measurements on a yarn without anti-tack additives using the OETO apparatus of the present invention. As can be seen in FIG. 8, the yarn tension 801 starts out at about 95 grams and climbs to about 150 grams at the end of the test cycle. This corresponds to an increase of about 58% in the yarn tension.

In addition, the graph of FIG. 8 shows brief spikes in the yarn tension up to the maximum measurement value of 180 grams. Moreover, the yarn could not be unwound to the core of the creel.

Figure 9:
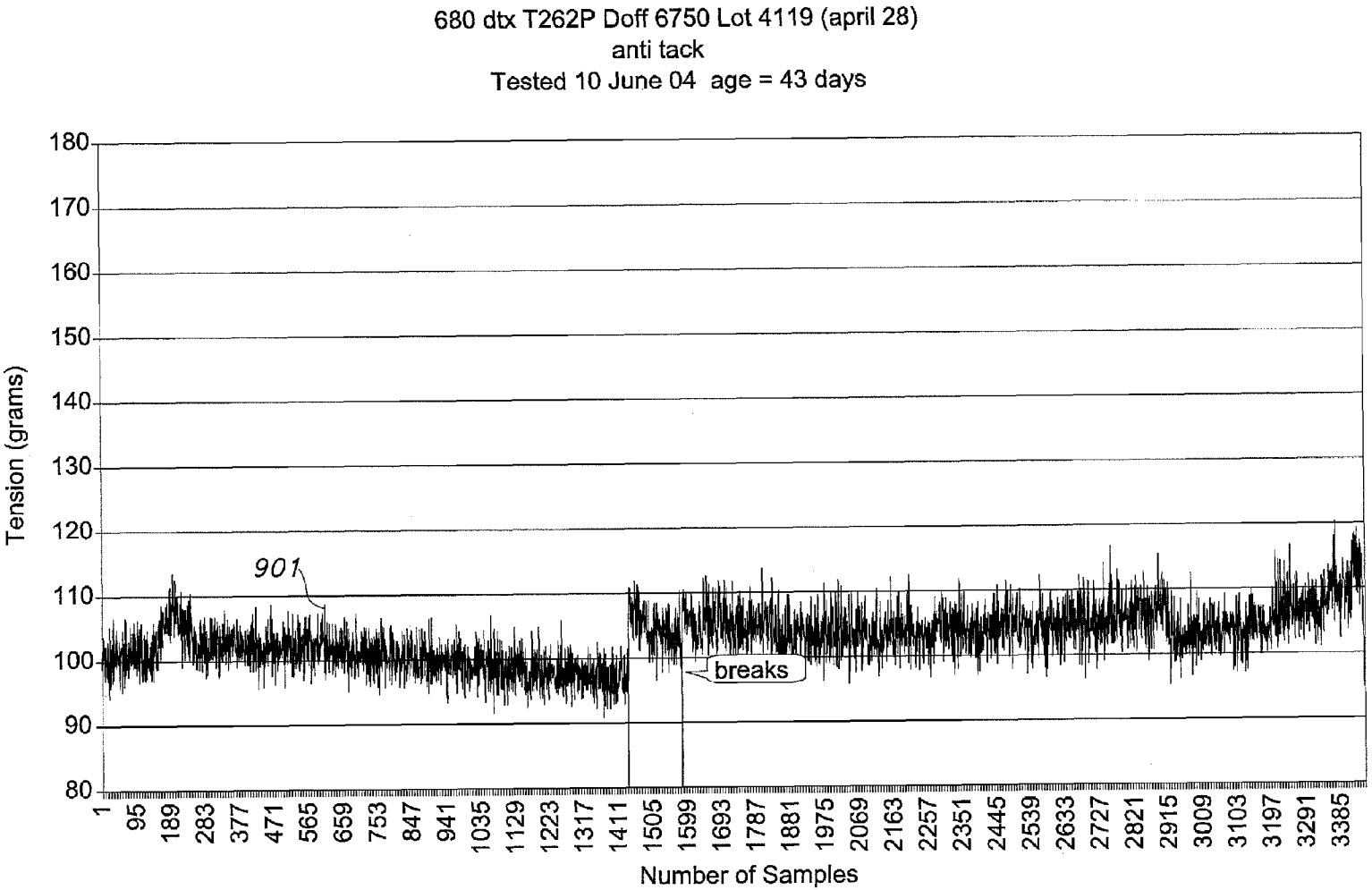
FIG. 9 is an exemplary graph showing test results of tension measurements on a yarn with anti-tack additives using the OETO apparatus of the present invention.

FIG. 9 is an exemplary graph showing test results of tension measurements on a yarn with a low level of anti-tack additives using the OETO apparatus of the present invention. As can be seen in FIG. 9, the yam tension 901 starts out at about 100 grams and climbs to about 120 grams at the end of the test cycle. This corresponds to an increase of about 20% in the yarn tension. Though this is a relatively constant value for yarn tension, there were still breaks in the yarn during the unwinding method, as illustrated in FIG. 9.

Figure 10:
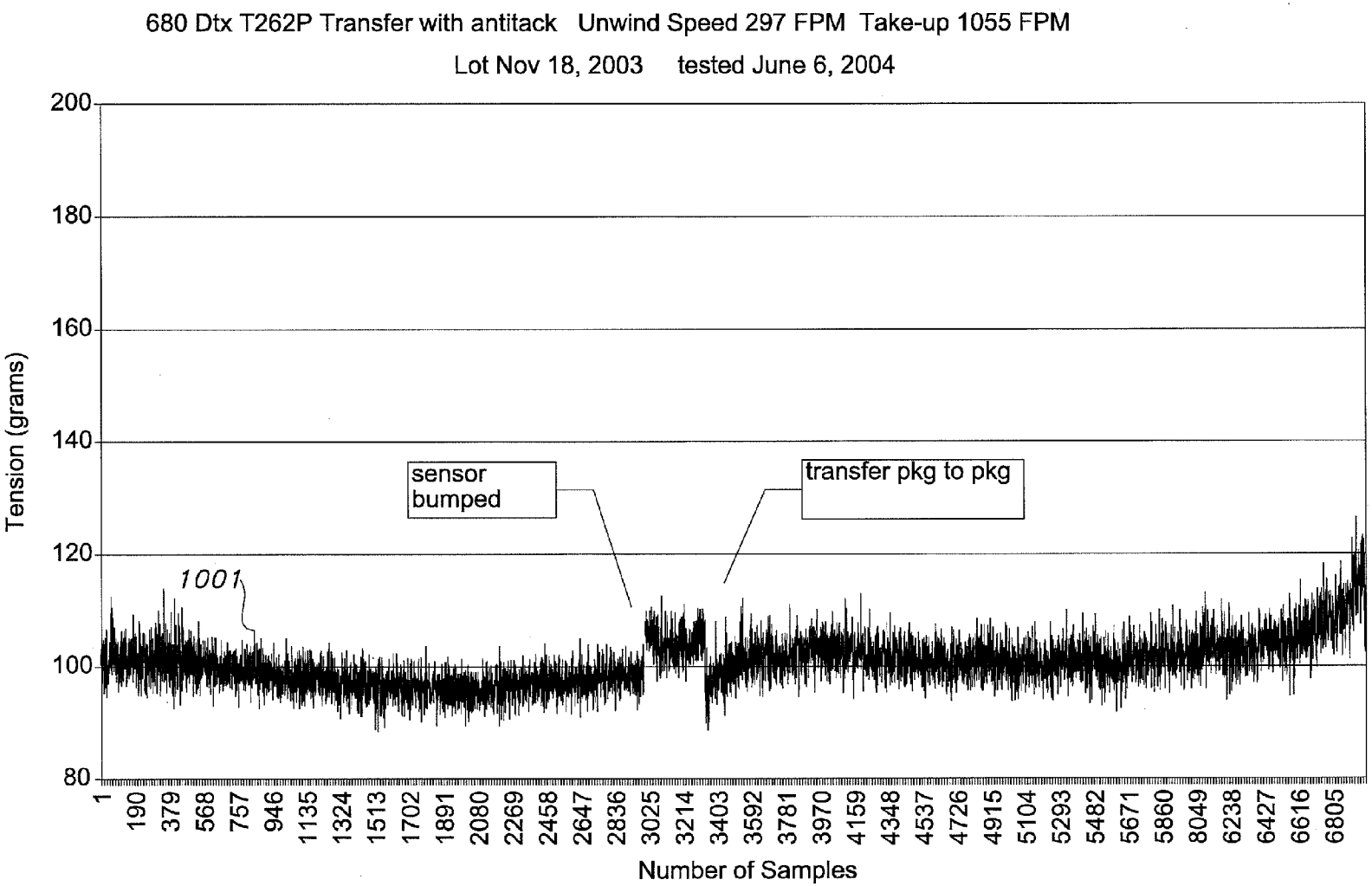
FIG. 10 is another exemplary graph showing test results of tension measurements on a yarn with anti-tack additives using the OETO apparatus of the present invention.

FIG. 10 is an exemplary graph showing test results of tension measurements on a yarn with anti-tack additives using the OETO apparatus of the present invention. As can be seen in FIG. 10, the yam tension 1001 starts out at about 100 grams and climbs to about 120 grams at the end of the test cycle. This corresponds to an increase of about 20% in the yam tension. In addition, there were step-like jumps in the yarn tension during the unwinding method as a result of the transfer from an active package to a standby package.

Figure 11:
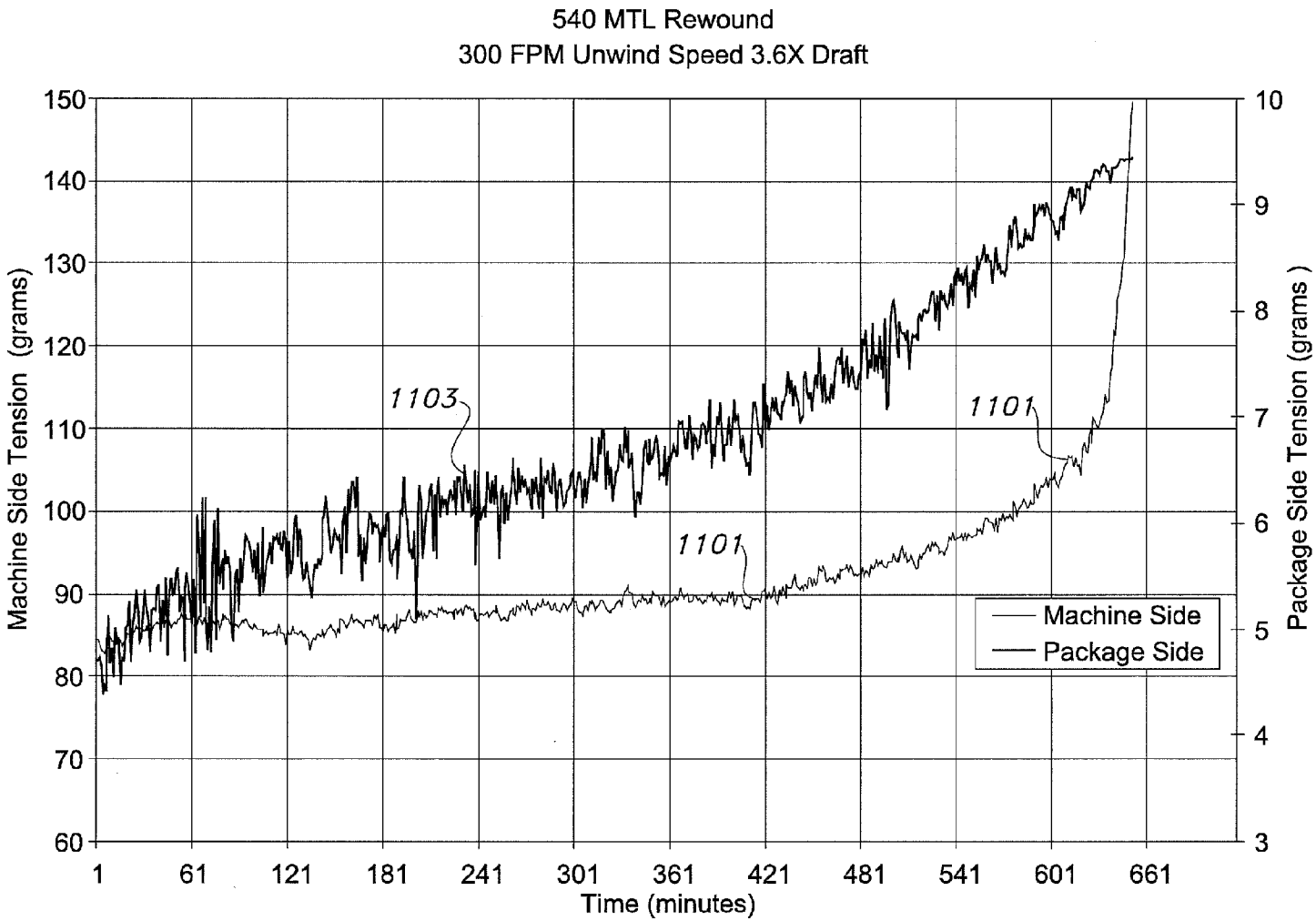
FIG. 11 is an exemplary graph showing tension measurement test results on a yarn on a rewound package using the OETO apparatus of the present invention.

FIG. 11 is an exemplary graph showing tension measurement test results on a yarn on a rewound package using the OETO apparatus of the present invention. FIG. 11 shows both the package side yarn tension 1101 and the machine side yarn tension 1103. In particular, FIG. 11 shows a package side yarn tension 1101 for a typical rewound package. The package side yarn tension starts out at about 80 grams and climbs to about 140 grams at the end of the test cycle. This corresponds to an increase of about 75% in the yarn tension.

Figure 12:
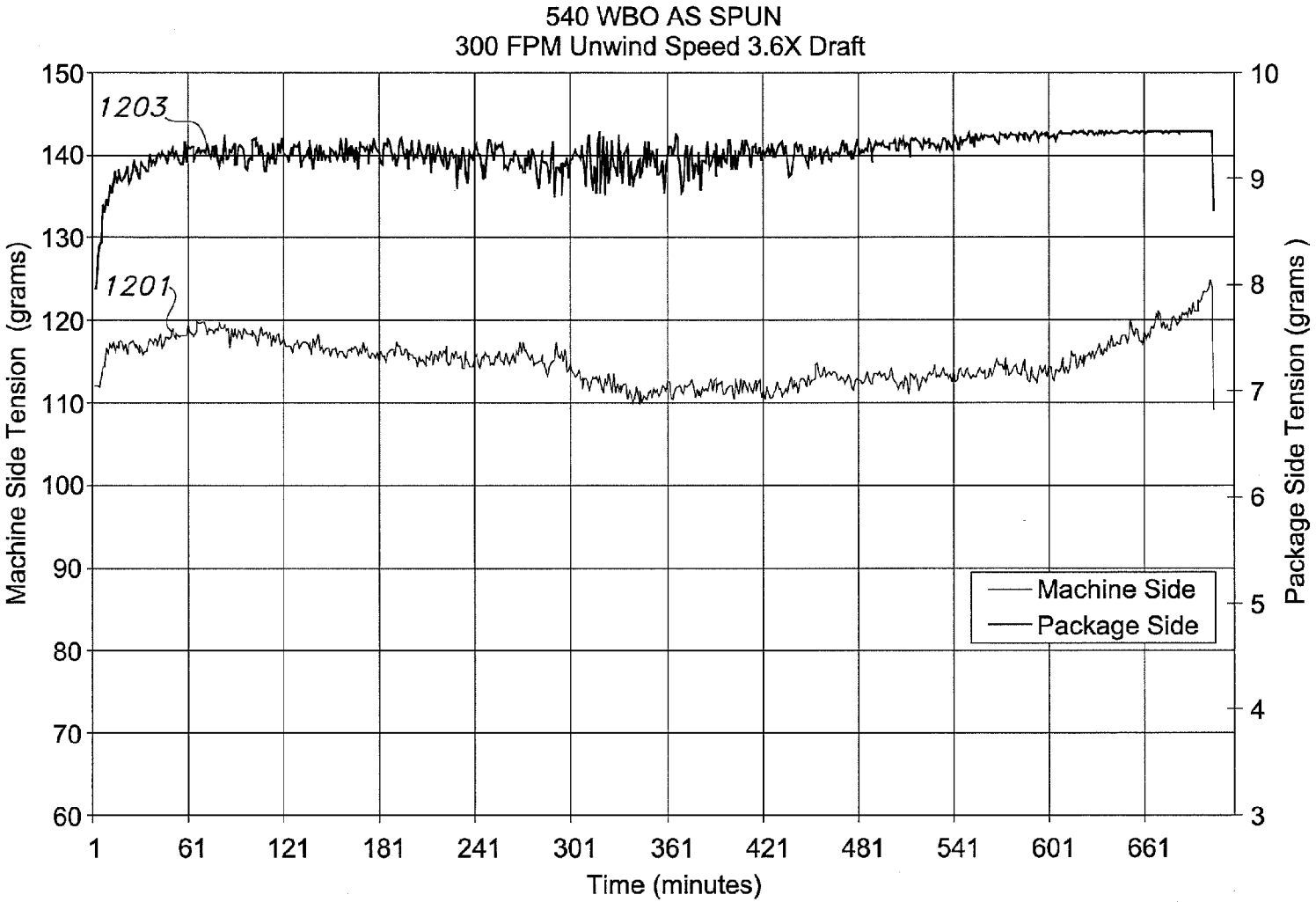
FIG. 12 is an exemplary graph showing tension measurement test results on an as-spun with anti-tack OETO yarn package that is unwound with the OETO apparatus of the present invention.

FIG. 12 is an exemplary graph showing tension measurements test results on an as-spun OETO with anti-tack yarn package that is unwound with the method and apparatus of the present invention. FIG. 12 demonstrates the desired relatively constant yarn tension. FIG. 12 also shows both the package side yarn tension 1201 and the machine side yarn tension 1203. In particular, the graph of FIG. 12 shows a package side tension 1201 that starts out at about 110 grams and only climbs to a maximum of 125 grams at the end of the test cycle. In contrast to the test results of FIG. 11, which showed a 75% increase in yarn tension, these test results indicate that the method and apparatus for unwinding of the present invention experiences an increase of only a 14% in yarn tension.

Figure 13:
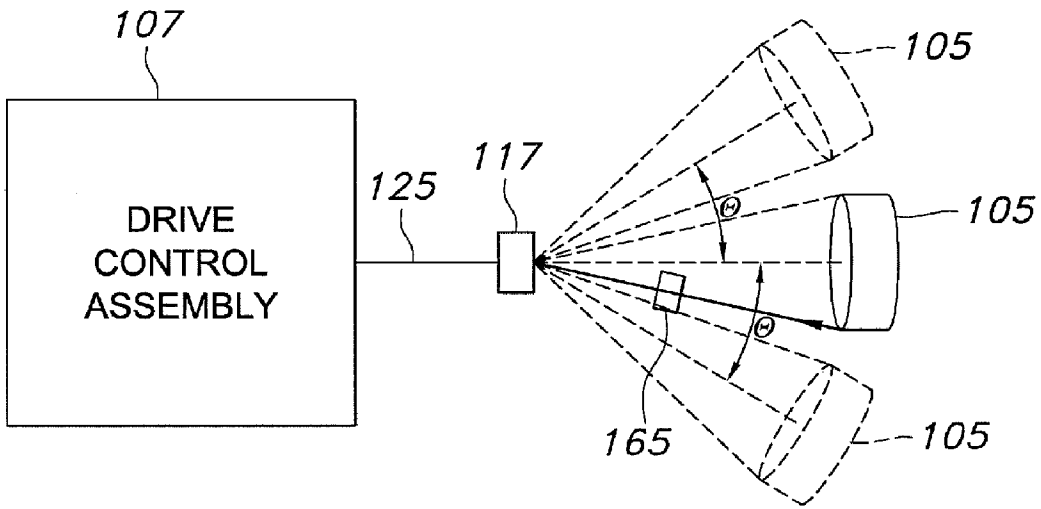
FIG. 13 illustrates how a desired angular orientation θ is maintained between the active package and the central leg of the frame of the apparatus of the invention.

FIG. 13 shows a configuration of the active package relative to the central leg 109 of the frame 110 of the invention. In FIG. 13, active packages 105 are maintained in a desired orientation by pivoting yarn holders 120 (FIG. 2). The diameter of the pivoting yarn holders 120 is smaller than the diameter of the open core of the active package 105 such that the active packages 105 can be slid over the suitably positioned pivoting yam holder 120 and such that the yarn 125 (FIG. 4) can be unwound from the active package 105 by the OETO apparatus of the present invention. The yarn 125 (FIG. 4) is then directed to the drive control assembly 107 for the unwinding process. A distance (d) between the active packages 105 and the first yarn guides 117, which is at least about 0.34 meter and preferably not more than about 0.91 meter, can be maintained for operation with high tack fibers. An acute angle (θ), defined by the intersection of the imaginary lines corresponding, respectively, to the rotational axis of the active packages 105 and the central axis of the static guide orifice that is perpendicular to the plane of the orifice, is preferably maintained between 0 and about 30° for operation with high tack fibers.

As the level of tack exhibited by the fiber increases, the maximum allowable angle, θ, decreases. The directional change of the yarn 125, as it passes through a first yarn guide 117, as measured in terms of θ, is preferably limited to between 0° and about 30° for yarns with tack levels greater than about 2 and less than about 7.5, and between 0° and about 10° for fibers with tack levels greater than about 7.5. Larger angles can result in excessive variations in thread line tension and draft, or even yarn breakage.

Therefore, as demonstrated by the above test results, the method and apparatus of the present invention provides an OETO method and apparatus for unwinding yarns with anti-tack additives that can be implemented in a relatively small footprint and avoids the problems of entanglement, breakage and increased manufacturing costs of the background art.

The foregoing description illustrates and describes the present invention. Additionally, the disclosure shows and describes only the preferred embodiments of the invention, but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. An apparatus for continuously unwinding yarns from one or more active packages, comprising:

a frame with at least one pivoting leg connected thereto;

two or more pivoting yarn holding arms attached to the pivoting leg;

first yarn guides attached to pivoting guide brackets with sleeves configured to allow the first yarn guides to pivot on the frame with respect to first and second mutually orthogonal axes;

a drive control assembly attached to the frame and configured to continuously unwind yarns from active packages installed on the pivoting yarn holding arms and fed through the guide brackets; and wherein the at least one pivoting leg is pivotably mounted at an acute angle relative to the frame, the first yarn guides are separated from the active packages by a minimum distance, the minimum distance from said first yarn guides to an end of said active package facing said first yarn guides measured on a line defined by the rotational axis of the active package and the acute angle is defined by the intersection of an imaginary line corresponding, respectively, to the rotational axis of the active package and the central axis of said first yarn guide that is perpendicular to a plane of an orifice, and the pivoting guide brackets are adjusted along said first and second mutually orthogonal axes in accordance with providing the acute angle relative to the frame.

2. The apparatus of claim 1, wherein the minimum distance is at least 0.34 meters.

3. The apparatus of claim 1, wherein the drive control assembly further comprises:

a separator roll attached to a front panel of the drive control assembly;

second yarn guides attached to the front panel of the drive control assembly;

a drive roll mounted for rotation on a shaft extending from the front panel of the drive control assembly;

a drive motor to drive the drive roll;

break sensors attached to the front panel of the drive control assembly; and third yarn guides attached to at least one of the front panel of the drive control assembly and the frame.

4. The apparatus of claim 3, wherein the drive roll has a polished metal surface finish that ensures good yarn-to-metal contact.

5. The apparatus of claim 3, wherein the drive roll and the separator roll are configured to enable multiple wraps of yarn on the drive roll.

6. The apparatus of claim 1, wherein the drive control assembly further comprises an electrical control box electrically connected to the drive control assembly.

7. The apparatus of claim 6, wherein the electrical control box further comprises:

a relay;

a first terminal block;

a second terminal block;

a power supply switch;

a digital converter connected to the second terminal block and the relay;

a master encoder connected to the second terminal block and the digital converter;

a drive motor controller connected to the first terminal block, second terminal block and the power supply switch;

a break detector interface connected to the relay and the second terminal block; and a power supply connected to the power supply switch, digital converter, master encoder, drive motor controller and break detector, wherein the drive motor controller and the break detector interface are electrically connected to the drive motor and the break detectors, respectively, by the first terminal block and the second terminal block.

8. The apparatus of claim 1, wherein each of the first yarn guides further comprises:

a sleeve mounted for rotation over a post portion of the pivoting leg;

a pivoting guide bracket extending from the sleeve and defining at least one vertical surface, a horizontal surface and a side surface;

a pigtail guide attached to the side surface of the pivoting guide bracket;

a vertically mounted yarn guide attached to one vertical surface of the pivoting bracket; and a horizontally mounted yarn guide attached to the horizontal surface of the pivoting bracket.

9. The apparatus of claim 1, wherein the acute angle is in the range of about 0° to 90°.

* * * * *